US008843048B2

(12) United States Patent
Goldbeck

(10) Patent No.: US 8,843,048 B2
(45) Date of Patent: Sep. 23, 2014

(54) DEVICE AND METHOD FOR APPLYING AND FUSING A TONER IMAGE ON A SUBSTRATE

(75) Inventor: Uwe Goldbeck, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 205 days.

(21) Appl. No.: 13/516,266

(22) PCT Filed: Dec. 9, 2010

(86) PCT No.: PCT/EP2010/069238
§ 371 (c)(1),
(2), (4) Date: Aug. 9, 2012

(87) PCT Pub. No.: WO2011/073074
PCT Pub. Date: Jun. 23, 2011

(65) Prior Publication Data

US 2012/0294661 A1 Nov. 22, 2012

(30) Foreign Application Priority Data

Dec. 18, 2009 (DE) ..... 10 2009 058 960

(51) Int. Cl.
*G03G 15/20* (2006.01)
*G03G 15/16* (2006.01)

(52) U.S. Cl.
CPC ..... *G03G 15/2007* (2013.01)
USPC ..... 399/336; 399/122

(58) Field of Classification Search
USPC ..... 399/122, 320, 335–337, 341
See application file for complete search history.

(56) References Cited

U.S. PATENT DOCUMENTS

| | | | | |
|---|---|---|---|---|
| 4,482,239 | A | 11/1984 | Hosono et al. | |
| 5,099,288 | A | 3/1992 | Britto et al. | |
| 5,256,507 | A | 10/1993 | Aslam et al. | |
| 5,631,685 | A | 5/1997 | Gooray et al. | |
| 7,184,698 | B2 * | 2/2007 | Tombs | 399/341 |
| 8,023,877 | B2 * | 9/2011 | Sudo et al. | 399/341 |
| 2002/0090238 | A1 | 7/2002 | Bartscher et al. | |
| 2007/0280758 | A1 | 12/2007 | Ciaschi et al. | |
| 2009/0076984 | A1 | 3/2009 | Guionnet | |
| 2009/0080090 | A1 | 3/2009 | Maruyama | |
| 2011/0311908 | A1 | 12/2011 | Schulze-Hagenest | |

FOREIGN PATENT DOCUMENTS

| | | |
|---|---|---|
| EP | 0758 766 | 5/2001 |
| EP | 2 107 430 | 10/2009 |
| WO | WO 2010/066267 | 6/2010 |

* cited by examiner

*Primary Examiner* — Hoan Tran
(74) *Attorney, Agent, or Firm* — Christopher J. White; Kevin E. Spaulding

(57) ABSTRACT

A device and a method for applying and fusing a toner image on a substrate is described. The device has at least one printing unit, a transport unit for transporting the substrate through a print area of the printing units and a fusing unit for fusing toner on the substrate. The transport unit has an endless transport belt which passes continuously around at least two rollers to form a transport side. The fusing unit is in a transport direction of the endless transport belt behind the at least one printing unit and has at least one microwave applicator arranged adjacently to the endless transport belt for introducing microwaves into the substrate while the latter is being transported through it. With the method, a substrate to be printed is held on an endless transport belt and moved thereon through a print area of at least one printing unit and then through a fusing unit. In the print area of the at least one printing unit, a toner image is applied to the substrate, and inside the fusing unit the toner image is fused on the substrate by heating up the toner image by use of microwaves.

14 Claims, 2 Drawing Sheets

DEVICE AND METHOD FOR APPLYING AND FUSING A TONER IMAGE ON A SUBSTRATE

FIELD OF THE INVENTION

The present invention relates to a device and a method for applying and fusing a toner image on a substrate.

BACKGROUND ART

It is generally known in engineering to use heat to fuse toner images, applied to a substrate using an electrophotographic printing unit, for example. When fusing heat, the toner is heated to above its glass temperature, i.e. melted, resulting in a close bond with the substrate. Furthermore, during heating it is possible that there will be a cross-linking of the toner particles, which increases the stability of the toner image in particular against heat effects.

A known fusing unit, as generally used for toner applications, has a heatable fusing roller and a pressure roller between which a fusing gap is formed for passing through of a substrate. To extend the fusing gap in the transport direction of the substrate and hence enlarge a contact surface between the substrate and the fusing roller, the pressure roller usually has an elastic surface which is compressed in the area of the fusing gap. At high fusing speeds, there is however the risk with a fusing unit of this type that substrate faults like substrate bucklings will occur in the area of the fusing gap, or that the substrate will wrap around the fusing roller. To prevent both this and the adhesion of toner particles to the fusing roller, it is know how to use separating oil on the fusing roller, which however can lead to other problems.

Furthermore, a fusing unit of this type must have a sufficient distance from the printing unit that it does not grip a substrate until it is completely removed from the printing unit, since the gripping of the substrate might otherwise impair the printing process. In particular, it is even usual to grip a substrate with the fusing unit of the above type only when the substrate has been completely released by the transporting mechanism that transports the substrate during toner application. This is intended to prevent the substrate firmly gripped by the rollers from disturbing an even movement of the transporting mechanism. This results in considerable space requirements for printing devices of this type.

SUMMARY OF THE INVENTION

Accordingly, the object of the present invention is to provide a device and a method of the aforementioned type which manage without separating oil and possibly allow a more compact design.

To achieve this object, a device according to Claim 1 and a method according to Claim 11 are provided. Further embodiments are detailed in the sub-claims.

In particular, a device for applying and fusing a toner image on a substrate has at least one printing unit for applying toner onto the substrate, a transport unit for transporting the substrate through a print area of the printing unit and a fusing unit for fusing toner on the substrate. The transport unit has an endless transport belt which passes continuously around at least two rollers to form a transport side, and the fusing unit is arranged in a transport direction of the endless transport belt behind the at least one printing unit. The fusing unit has at least one microwave applicator arranged adjacently to the endless transport belt for introducing microwaves into the substrate while the latter is being transported through it. By using a microwave applicator, a no-contact heating up of the toner to above its glass temperature is possible, so that the problems associated with separating oil can be avoided. In particular, however, it is also possible to achieve fusing directly following toner application, since the no-contact heating does not affect the toner application. This permits fusing of the toner on the same transporting unit that transports the substrate through the print area of the printing unit, permitting a compact design.

In one embodiment, the fusing unit has an endless belt which passes continuously around at least two rollers to form a contact side, the endless belt being arranged such that its contact side is directly opposite the transport side of the endless transport belt. Directly opposite is intended to describe in particular a contact of the respective sides, which however can also be a slight distance apart. In any event, the distance should be so small that a substrate with toner held in between is in flat contact with both the transport side and the contact side. As a result, constant fusing conditions can be achieved in particular also for duplex printing. In particular, the endless transport belt and the endless belt can be arranged in a frictional contact to one another. This permits in simple manner a synchronous movement of the two belts.

Preferably, at least one microwave applicator is arranged such that it introduces microwaves into an area in which the endless transport belt and the endless belt are directly opposite. To do so, the microwave applicator can be arranged between rolls of the endless transport belt and/or of the endless belt.

To ensure good release of a toner image from the endless transport belt and/or the endless belt, the fusing unit preferably has at least one cooling unit arranged in the transport direction of the endless transport belt behind the at least one microwave applicator. This permits a toner image to be cooled to below its glass temperature while it is still being transported by the endless transport belt. In particular, the cooling unit can be arranged such that it can cool a substrate while it is in contact with the endless transport belt and/or the endless belt.

In a preferred embodiment, the surface of the endless transport belt and/or of the endless belt has a certain surface quality to generate a predetermined gloss of the toner image.

In order to promote not only thermal cross-linking but also UV cross-linking of toner particles, the fusing unit can have at least one UV radiation source arranged in the transport direction of the endless transport belt behind the at least one microwave applicator.

The object underlying the invention is also achieved by a method for applying and fusing a toner image on a substrate in which a substrate to be printed is held on an endless transport belt and moved with the endless transport belt through a print area of at least one printing unit and then through a fusing unit. In the print area of the at least one printing unit, a toner image is applied to the substrate, and inside the fusing unit the toner image is fused on the substrate by heating up of the toner image by means of microwaves. With this method, the aforementioned advantages can be achieved.

Preferably, a surface of the substrate facing away from the endless transport belt is brought into contact inside the fusing unit with an endless belt, in order for example to achieve in simplex printing a certain gloss setting or to fuse both printed sides evenly in duplex printing. To achieve good release of the toner image, the substrate is preferably cooled while it is in contact with the endless transport belt and/or the endless belt.

In one embodiment, the toner image is heated during fusing to above a glass temperature of the toner of the toner image and can be subjected to UV radiation while the toner is heated to above its glass temperature. As a result, depending on the toner its cross-linking can be promoted in order to achieve a higher stability of the toner image.

For duplex printing, the substrate is turned after applying and fusing the toner image and returned to the endless transport belt in order to apply and fuse a toner image on the rear of the substrate.

BRIEF DESCRIPTION OF THE DRAWINGS

The invention is explained in more detail in the following with reference to the drawing, which shows in.

DETAILED DESCRIPTION OF THE INVENTION

Figure 1:
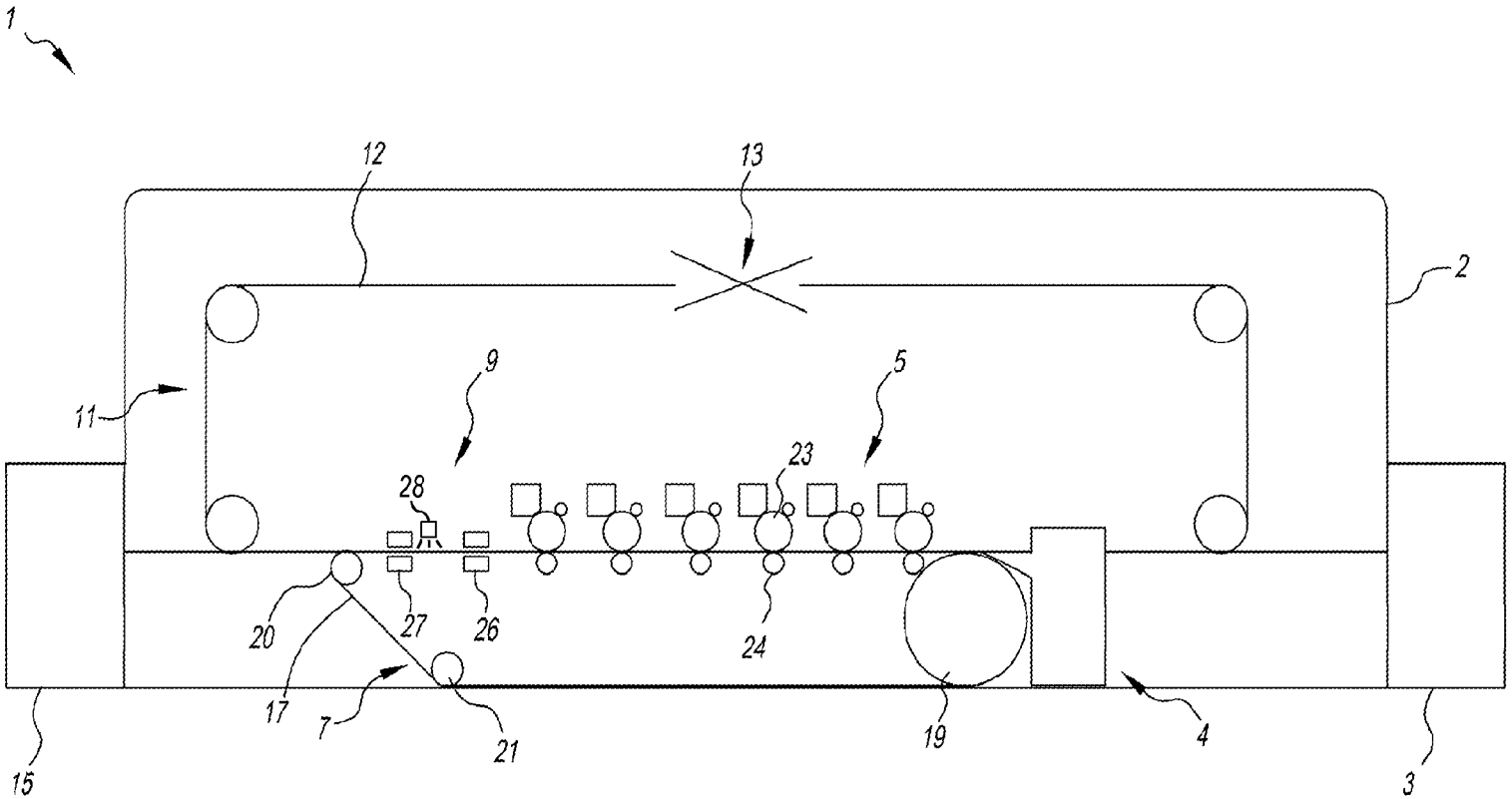
FIG. 1 a schematic side view of a printing press in accordance with a first embodiment.

The position and direction information provided in the following description relate primarily to the illustration in the drawing and should therefore not be deemed to be restrictive. They can however also relate to a preferred final arrangement.

FIG. 1 shows a schematic side view of a multi-color printing press 1 with an apparatus housing 2, a feeder 3, an alignment unit 4, a plurality of printing units 5, a first transport unit 7, a fusing unit 9, a second transport unit 11 forming a duplex path 12 with turning unit 13 and a delivery unit 15.

Multi-color printing presses of this type are known in a wide variety of embodiments, and FIG. 1 illustrates only a highly simplified example.

The apparatus housing 2 encloses the various units of the multicolor printing press 1, with the exception of the feeder 3 and the delivery unit 15, which are external units in the configuration shown. They can however also be integrated inside the apparatus housing 2, as known from the prior art. The apparatus housing 2 serves to protect the units inside the apparatus housing 2 from contamination and from unauthorized access.

The feeder 3 is used to hold a sheet stack and for individual feeding of sheets from the sheet stack to the alignment unit 4, where a part of the second transport unit 11 transports the sheets from the feeder 3 to the alignment unit 4. The alignment unit 4 is of a suitable type that aligns sheets fed to it and transfers them to the first transport unit 7.

The first transport unit 7 has a continuous transport belt 17 passed around corresponding transport and guide rollers 19, 20 and 21, at least one of which is connected to a corresponding drive unit. Between the transport and guide rollers 19 and 20, the transport belt 17 forms a transport strand, on which sheets are transported from the alignment unit 4 through the printing units 5 and the fusing unit 9. The transport belt 17 can be a transparent transport belt that can be electrostatically charged to fix sheets on it.

The printing units 5 are arranged relative to the first transport unit 7 such that they are suitable for printing respective color separations on sheets transported through the first transport unit 7. In the multi-color printing press 1 as shown, five printing units are illustrated, which can for example be operated with the colors black, cyan, magenta, yellow and a special ink, for example clear dry ink. The printing units 5 are each of a known electrophotographic type that applies toner images to the respective sheet. To do so, the printing units each have an imaging drum 23 that can be imaged using suitable units, and also a counter-pressure roller 24 that presses against the imaging drum 23. The gap between the imaging drum and the counter-pressure roller contains the print area of the printing units 5, meaning the area in which a toner separation is transferred to a sheet. The transport side of the transport belt 17 extends through the respective print areas of the printing units 5 and can therefore transport sheets through the print areas.

The fusing unit 9 has a microwave applicator 26 and a cooling unit 27 which form a heating area or a cooling area between them. The transport side of the transport belt 17 extends through both the heating area and the cooling area. The microwave applicator 26 comprises, as illustrated, two applicator elements which between them form a gap through which the transport side of the transport belt 17 is passed. The microwave applicator can however also be of a type with only one applicator element, arranged for example above and adjacently to the transport side of the transport belt 17. It is also possible to provide several microwave applicators.

The cooling unit 27 too comprises two cooling elements which between them form a gap through which the transport side of the transport belt 17 is passed. The cooling elements can for example each be of the type that directs cooling air in the direction of the transport belt 17. It is however possible for example to provide only one cooling element or a larger number of cooling elements. The cooling elements can also be of another type. It is for example possible in particular for the cooling element underneath the transport side of the transport belt 17 to have a cooled surface or roller which is in contact with the transport belt 17. For example the roller 20 could also be cooled and form part of the cooling unit 27.

Furthermore, a UV light source 28, can be arranged In the transport direction of the transport belt 17 between the microwave applicator 26 and the cooling unit 27 and direct the UV light from above and/or from below in the direction of the transport belt 17.

The second transport unit 11 is arranged adjacent to an output end of the first transport unit 7 and is used to take over sheets from the transport belt 17 and pass them via the duplex path 12 and the turning device 13 back to the alignment unit 4 or to pass them to the delivery unit 15. To do so, the second transport unit 11 is designed in the known manner and can have several transport units in a row and if necessary switches for guiding sheets along required routes. The turning device 13 arranged in the duplex path 12 is of a suitable type that can turn sheets transported along the duplex path 12 in a known manner for verso printing. The delivery unit 15 is in turn of any suitable type for picking up sheets after printing and fusing.

Figure 2:
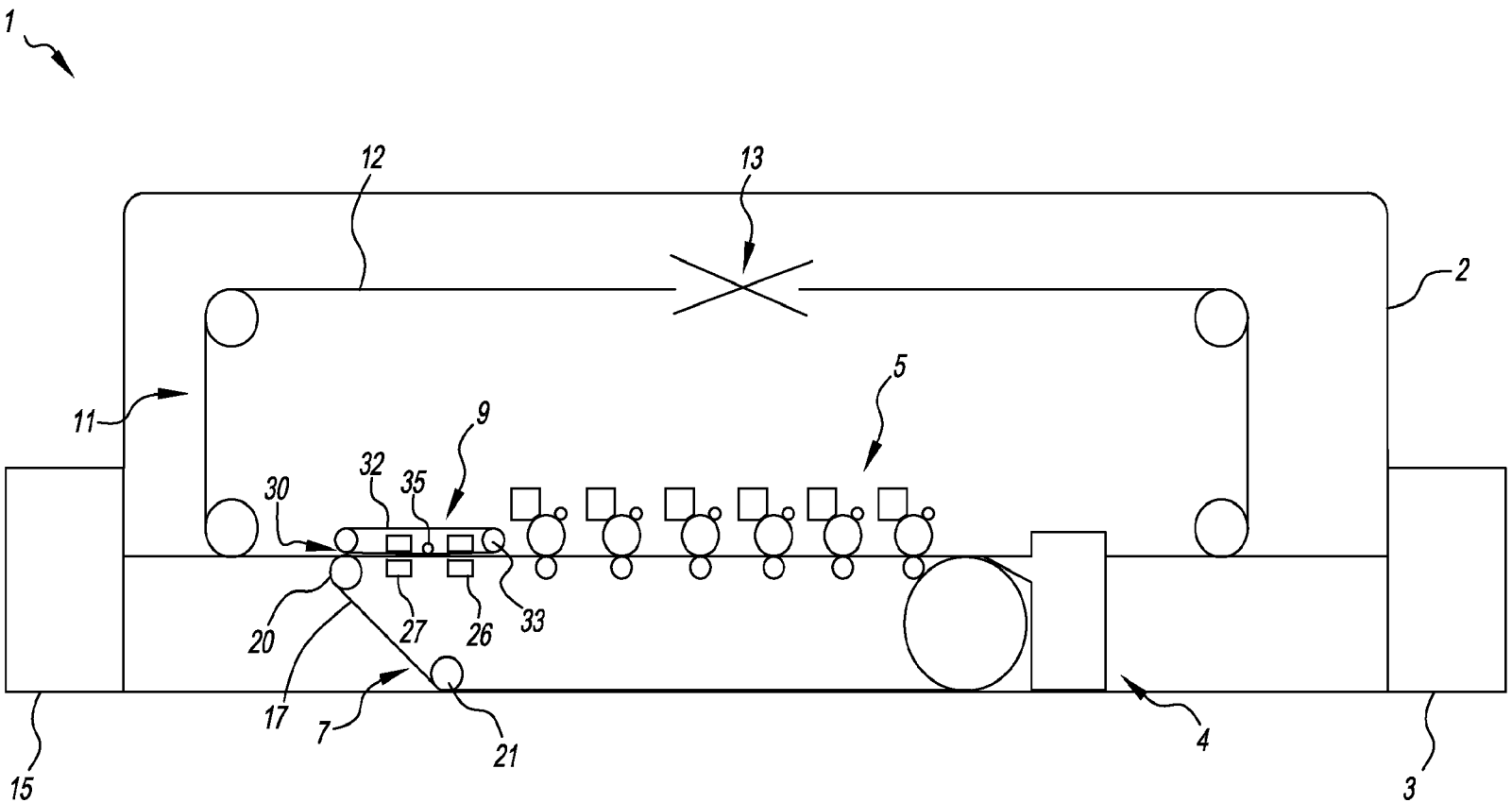
FIG. 2 a schematic side view of a printing press in accordance with a second embodiment.

FIG. 2 shows a schematic side view of an alternative multi-color-printing press 1. In FIG. 2 the same reference numbers are used as in FIG. 1 where the same or similar elements are described. The multi-color printing press 1 has in turn an apparatus housing 2, a feeder 3, an alignment unit 4, a plurality of printing units 5, a first transport unit 7, a fusing unit 9, a second transport unit 11 forming a duplex path 12 with the turning unit 13, and a delivery unit 15.

Except for the fusing unit 9, the elements and their arrangement are identical to the elements described with reference to FIG. 1, so any further description is dispensed with to avoid repetition. In this embodiment too, the first transport unit 7 has a continuously running transport belt 17 with a transport side extending between an input end adjacent to the alignment unit and an output end adjacent to the second transport unit 11.

The fusing unit 9 has in this embodiment a microwave applicator 26 as well as a cooling unit 27 which form a heating area or a cooling area between them. However, it additionally also has a contact arrangement 30 explained in greater detail in the following.

The transport side of the transport belt 17 extends through both the heating area and the cooling area. The microwave applicator 26 comprises once again two applicator elements which between them form a gap through which the transport side of the transport belt 17 is passed. The microwave applicator 26 can have the same design as described previously.

The cooling unit 27 too again comprises two cooling elements which between them form a gap through which the transport side of the transport belt 17 is passed. The cooling unit 27 can also again be designed exactly as described above. In particular, however, it is also possible with this embodiment to design the cooling unit positioned above the transport side of the transport belt 17 in contacting form. Also, a UV light source, not shown, can again be arranged in the transport direction of the transport belt 17 between the microwave applicator 26 and the cooling unit 27, and directs the UV light from above and/or from below in the direction of the transport belt 17.

The contact arrangement 30 of the fusing unit 9 has an endless belt 32 that is passed around two guide rollers 33. In the area of the guide rollers 33 for the endless belt 32, guide rollers are also provided for the transport belt 17 and press against the guide rollers 33. As a result, the endless belt 32 and the transport belt 17 between them are brought into contact. The endless belt 32 and also the transport belt 17 can be designed as so-called glosser belts that have a certain surface structure, in particular a smooth surface structure in order to imprint on a toner image a certain gloss pattern, as is known in the prior art.

The endless belt 32 forms between the guide rollers 33 a contact side facing the transport side of the transport belt 17 and contacting the latter. In particular, the contact side and the transport side are in frictional contact with one another, such that a movement of the transport belt 17 also effects a corresponding synchronous movement of the endless belt 32. A frictional contact of this type is in particular also provided in the area of the guide rollers 33 for the endless belt 32 with the corresponding guide rollers for the transport belt.

To achieve a good contact between the contact side and the transport side, a deflecting roller 35 is provided in an area between the guide rollers 33 and deflects the contact side and the transport side out of the plane. As shown in FIG. 2, the deflecting roller 35 contacts the endless belt 32 and deflects the contact side between the guide rollers 33 downwards. It is of course also possible for the deflecting roller 35 to contact the transport belt 17 and deflect it upwards in the area between the guide rollers 33 for the endless belt 32. It is however also conceivable that the contact side and the transport side are not in continuous contact with one another. A distance between them should however at no time be greater than the width of a sheet with toner on it, so that a sheet of this type can always contact both sides.

The following now describes in greater detail the operation of the printing press 1 using FIGS. 1 and 2.

Generally, sheets are printed by the printing units 5 with toner images which are then fused in the fusing unit 9. Then the sheets are passed to the delivery unit 15 or introduced into the duplex path 12. Sheets entering the duplex path 12 are turned for verso printing. Then they are again printed by the printing units 5 with toner images which are in turn fused in the fusing unit 9. Finally, the double-printed sheets are passed to the delivery unit 15.

In detail, separate sheets are fed by the feeder 3 to the alignment unit 4 and aligned in a suitable way inside the latter. Then the sheets are transferred sequentially to the transport belt 17 of the first transport unit 7. On the transport belt 17 of the first transport unit 7, the sheets are held electrostatically in the known manner and thus securely against slipping. The transport belt 17 of the first transport unit 7 then transports the sheets along the printing units 5 in which toner images are applied in the known manner. Then the transport belt 17 of the first transport unit 7 transports the sheets through the fusing unit 9. Inside the fusing unit 9, the previously applied toner images are then heated by microwaves to above the glass temperature of the toner. In the embodiment according to FIG. 1, the toner image is exposed in the upward direction and not contacted. In the embodiment according to FIG. 2, by contrast, the toner image is contacted by the endless belt 32 in the area of the fusing unit 9. The endless belt 32 here contacts the toner image while the toner is heated to above its glass temperature. After heating of the toner image, it is then cooled by the cooling unit while the sheets are still on the transport belt 17 and possibly in contact with the endless belt 32. In particular, the toner image is cooled to below the glass temperature of the toner. Between heating and cooling, the toner image can also be subjected to UV light to promote cross-linking of toner particles, assuming the toner in question is UV-cross-linkable.

After this fusing of the toner images, the sheets are then transferred to the second transport unit 11 and fed either to the delivery unit 15 or to the duplex path 12. Sheets going into the duplex path 12 are turned inside the turning unit 13 for verso printing and returned to the alignment unit 4. Inside the latter, the sheets are again aligned and then transferred to the transport belt 17 of the first transport unit and transported thereon through the printing units 5 and the fusing unit 9. The printing units apply a toner image to the verso printing side of the sheets. Inside the fusing unit, the toner image is now fused on the verso printing side by heating the toner with microwaves to above the glass temperature of the toner. It is probable here that the toner image on the first-printed side of the sheets, i.e. the recto printing side, is also again heated to above the glass temperature of the toner. In this case, the embodiment according to FIG. 2 is preferred, whereby the sheets are held like a sandwich and passed inside the fusing unit between the contact side of the endless belt 32 and the transport side of the transport belt 17. As a result, an even structure of the toner images can be ensured both on the recto printing side and on the verso printing side. In the fusing unit, the toner images are then again cooled by the cooling unit to below the glass temperature of the toner. A UV radiation of the toner images can again take place between heating and cooling.

Then the sheets are again transferred to the second transport unit 11 and now fed to the delivery unit 15.

Previously, the invention was explained in detail with reference to preferred embodiments, without being restricted to specifically illustrated embodiments. In particular, a printing press can have fewer or more printing units than the five printing units shown. Also, several feeders and/or delivery units, for example in the form of a proofing delivery unit, can be provided and appropriate transport routes can be provided.

The invention claimed is:

1. Device for applying and fusing a toner image on a substrate having the following:

at least one printing unit for applying toner to the substrate;

a transport unit for transporting the substrate through a print area of the printing unit, where the transport unit has an endless transport belt which passes continuously around at least two rollers to form a transport side on which the substrate is transported through the print area; and a fusing unit for fusing toner on the substrate and arranged in a transport direction of the endless transport belt behind the at least one printing unit, wherein the fusing unit has at least one microwave applicator arranged adjacently to the endless transport belt for introducing microwaves into the substrate while the substrate is being transported on the endless transport belt through the microwave applicator;

the fusing unit has two rollers and an endless belt entrained around the two rollers to define a contact side, the endless belt being arranged such that its contact side is directly opposite the transport side of the endless transport belt, so that the substrate with the applied toner is held in between the transport side and the contact side; and the at least one microwave applicator is arranged such that it introduces microwaves into an area in which the endless transport belt and the endless belt are directly opposite.

2. The device according to claim 1, wherein the microwave applicator is arranged between rollers of the endless transport belt and/or of the endless belt.

3. The device according to claim 1, wherein the fusing unit has at least one cooling unit arranged in the transport direction of the endless transport belt behind the at least one microwave applicator to permit cooling of a substrate while it is being transported by the endless transport belt.

4. The device according to claim 3, wherein the cooling unit is arranged such that it can cool a substrate while it is being contacted by the endless transport belt and/or the endless belt.

5. The device according to claim 1, wherein the surface of the endless transport belt and/or of the endless belt has a surface structure adapted to generate a predetermined gloss of the toner image.

6. The device according to claim 1, wherein at least one printing unit is an electrophotographic printing unit.

7. The device according to claim 1, wherein the fusing unit has at least one UV radiation source arranged in the transport direction of the endless transport belt behind the at least one microwave applicator, to promote cross-linking of toner on the substrate while the latter is being transported by the endless transport belt.

8. The device according to claim 1, wherein the endless transport belt and the endless belt are arranged in frictional contact with one another.

9. Method for applying and fusing a toner image on a substrate comprising:

holding the substrate to be printed on an endless transport belt;

transporting the substrate using the endless transport belt through a print area of at least one printing unit and then through a fusing unit;

applying a toner image onto the substrate in the print area of the at least one printing unit while the substrate is transported through the print area; and fusing the toner image on the substrate while the substrate is transported through the fusing unit by bringing a surface of the substrate facing away from the endless transport belt into contact with an endless belt inside the fusing unit and then heating the toner image using microwaves.

10. The method according to claim 9, wherein the substrate is cooled while it is in contact with the endless transport belt or the endless belt.

11. The method according to claim 9, wherein the toner image is heated during fusing to above a glass temperature of the toner of the toner image.

12. The method according to claim 11, wherein the toner image is subjected to UV radiation while the toner is heated to above its glass temperature.

13. The method according to claim 9, wherein the substrate is turned after applying and fusing the toner image and returned to the endless transport belt in order to apply and fuse a toner image on the rear of the substrate.

14. The method according to claim 9, wherein the surface of the endless transport belt or of the endless belt has a surface structure adapted to generate a predetermined gloss of the toner image during the fusing step.

* * * * *